US005078609A

United States Patent [19]

Bouchan et al.

[11] Patent Number: 5,078,609

[45] Date of Patent: Jan. 7, 1992

[54] PLURAL JACK CONNECTOR MODULE

[75] Inventors: Christophe A. Bouchan, Longjumeau; Marcel D. Andre, Vert Saint Denis, both of France

[73] Assignee: Molex Incorporated, Lisle, Ill.

[21] Appl. No.: 686,912

[22] Filed: Apr. 15, 1991

[51] Int. Cl.[5] ..... H01R 13/00

[52] U.S. Cl. ..... 439/43; 439/441; 439/676

[58] Field of Search ..... 439/43-54, 439/436-441, 676

[56] References Cited

U.S. PATENT DOCUMENTS 4,535,388 8/1985 Kraus et al. ..... 439/43
4,545,632 10/1985 Maier et al. ..... 439/43
4,548,447 10/1985 Dinsmore ..... 439/43

*Primary Examiner*—Joseph H. McGlynn

*Attorney, Agent, or Firm*—Louis A. Hecht; Charles S. Cohen; Stephen Z. Weiss

[57] ABSTRACT

A wiring module is provided for use in a jack type electrical connector system and includes an insulative base module having a plurality of holes. At least two sets of electrical circuits are disposed within the thickness of the base module. The two sets of electrical circuits are insulatively separated from each other. Each set includes a plurality of circuits, and each circuit has a lead portion exposed at a side of the base module for electrical connection with a complementary terminal of a mating connector device. Each circuit in each set of circuits includes a contact portion exposed in a respective one of the holes in the base module. Therefore, a terminating device inserted into any one of the holes in the base module will engage a contact portion of one of the circuits in both sets thereof.

28 Claims, 6 Drawing Sheets

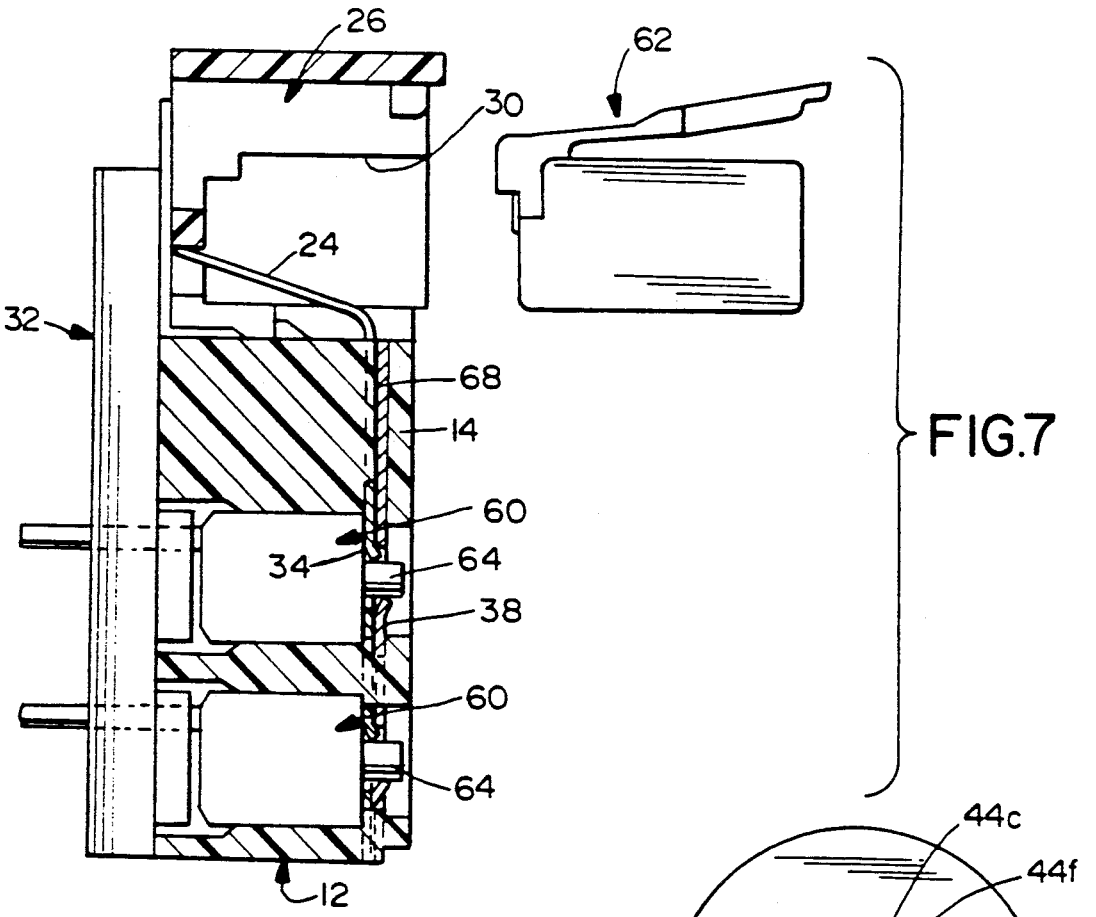
FIG.7
FIG.8
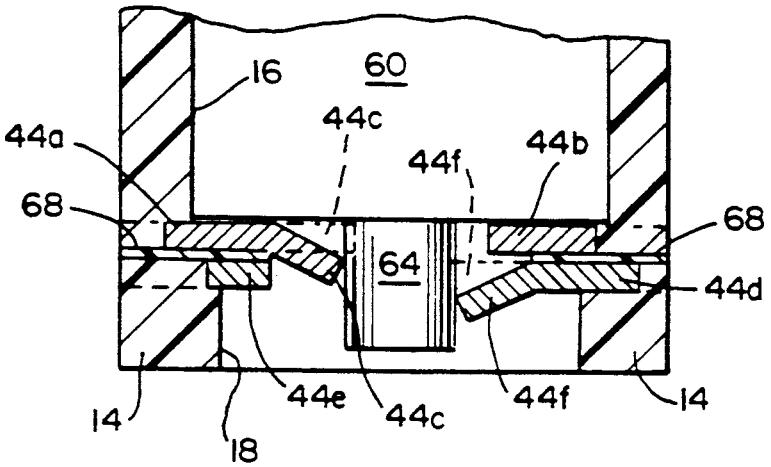
FIG.9

PLURAL JACK CONNECTOR MODULE

FIELD OF THE INVENTION

This invention generally relates to the art of electrical connectors and, particularly, to a jack module for a plurality of jack type connectors.

BACKGROUND OF THE INVENTION

Modular jack and plug connector systems have become standard interconnect systems in the telephone and other communications industries. Such modular jacks and plugs also are used in data processing and transmitting systems, as well as consumer and business machines, for interconnecting such equipment over telephone communication networks. In fact, both new and existing wiring systems must be fitted or retrofitted with standard jacks. Whether new or existing wiring systems are involved, the systems are tailored individually for modular jack and plug installations.

A modular jack is a relatively simple component that includes a molded dielectric housing including a plurality of terminals having cantilevered spring contacts for engaging contacts of a modular plug. There are various techniques for wiring the modular jacks into respective circuits. One such technique involves a molded dielectric base having a plurality of metal strip circuits embedded in the base, with free terminal portions projecting from an edge of the base and forming the cantilevered spring contacts of a modular jack. A jack housing simply is mounted on the dielectric base, with the cantilevered spring contact portions of the strip circuits located in the jack housing. One such wiring module is shown in U.S. Pat. No. 4,921,436, dated May 1, 1990. A problem with such existing wiring modules is their limitation of interconnecting with a single modular jack in any given area of cavities in a cantilevered fashion for electrical connection with contacts of the plug type connector inserted into the respective jack cavity. In addition, the base module includes a plurality of integrally molded sockets in registry with the holes in the base module for receiving a plurality of terminating devices, such as the barrel type terminal devices.

In the exemplary embodiment of the invention, each of the sets of circuits are generally planar and fabricated of stamped and formed metal material. Each contact portion of each circuit has aperture means in registry with its respective hole in the base module. In the preferred embodiment, each contact portion has a resilient tab projecting into its respective aperture means for engagement by one of the terminating devices inserted into the respective hole in the base module. The contact tabs of the circuits of the two sets thereof are diametrically disposed from each other across the respective hole in the base module and are diametrically spaced from each other. The generally planar sets of circuits are spaced from each other within the insulative base module by a layer of insulating material. Therefore, with the tabs are spaced diametrically and axially of the holes in the base module, the tabs can be bent sufficiently, without contacting each other, to provide a good frictional conductive engagement between the tabs and a terminal pin of the terminating device.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 7 is a fragmented vertical section through the base module and the assembled jack housing, with the module cover shown in elevation, and with a terminating plug device in position about to be inserted into the jack housing;

FIG. 8 is a top plan view looking down through one of the holes in the base module, showing the circuit contact tabs exposed in the hole;

FIG. 9 is a fragmented section through the base module, illustrating how the contact tabs are bent by a terminal of a terminating device;

DETAILED DESCRIPTION OF THE PREFERRED EMBODIMENT

Figure 1:
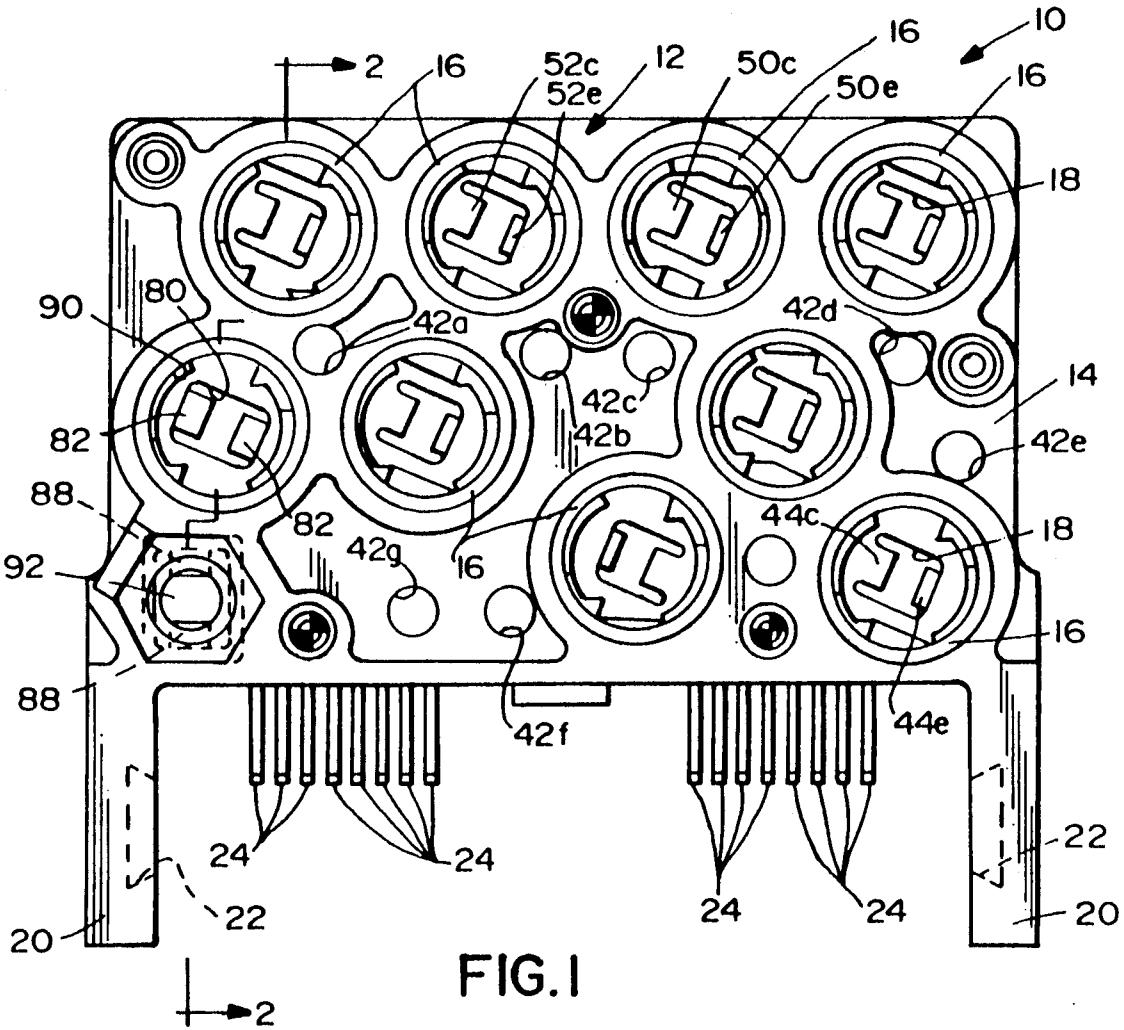
FIG. 1 is a top plan view of an insulative base module incorporating the concepts of the invention.
Figure 2:
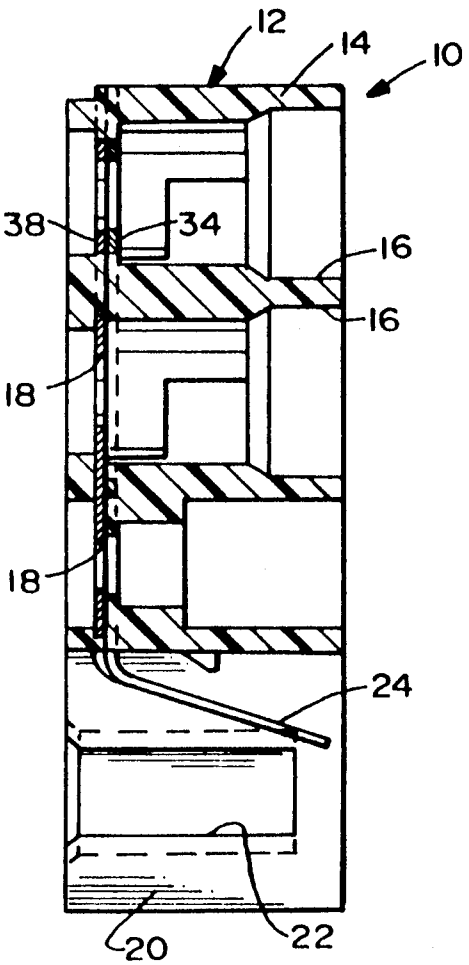
FIG. 2 is a vertical section taken generally along line 2—2 of FIG. 1.

Referring to the drawings in greater detail, and first to FIGS. 1 and 2, the invention contemplates an electrical connector system including a wiring module, generally designated 10, having an insulative base module, generally designated 12, unitarily molded of dielectric material, such as plastic or the like. Base module 12 includes a generally flat base portion 14 having a plurality of upwardly projecting cylindrical sockets 16. The sockets are provided for receiving a terminating device, such as a telephone barrel type terminal device, but it should be understood that the invention contemplates that sockets 16 can be of a variety of configurations. Base portion 14 includes a plurality of spaced holes 18 which are shown as being generally square, but, again, the holes can be round, rectangular or any configuration complementary to a terminal pin of the respective terminating device to be positioned in the socket.

Base module 12 also has a pair of arms 20 projecting from one edge thereof, each arm including a dove-tail slot 22 for assembling a jack housing to the module, as described hereinafter. Also as described in greater detail hereinafter, lead portions 24 of the two sets of electrical circuits are shown in FIGS. 1 and 2 projecting outwardly from the base module between arms 20. These lead portions are bent in a cantilever fashion, as best seen in FIG. 2, to provide cantilevered spring contacts within the jack housing in a manner which is conventional in telephone jack systems.

Figure 3:
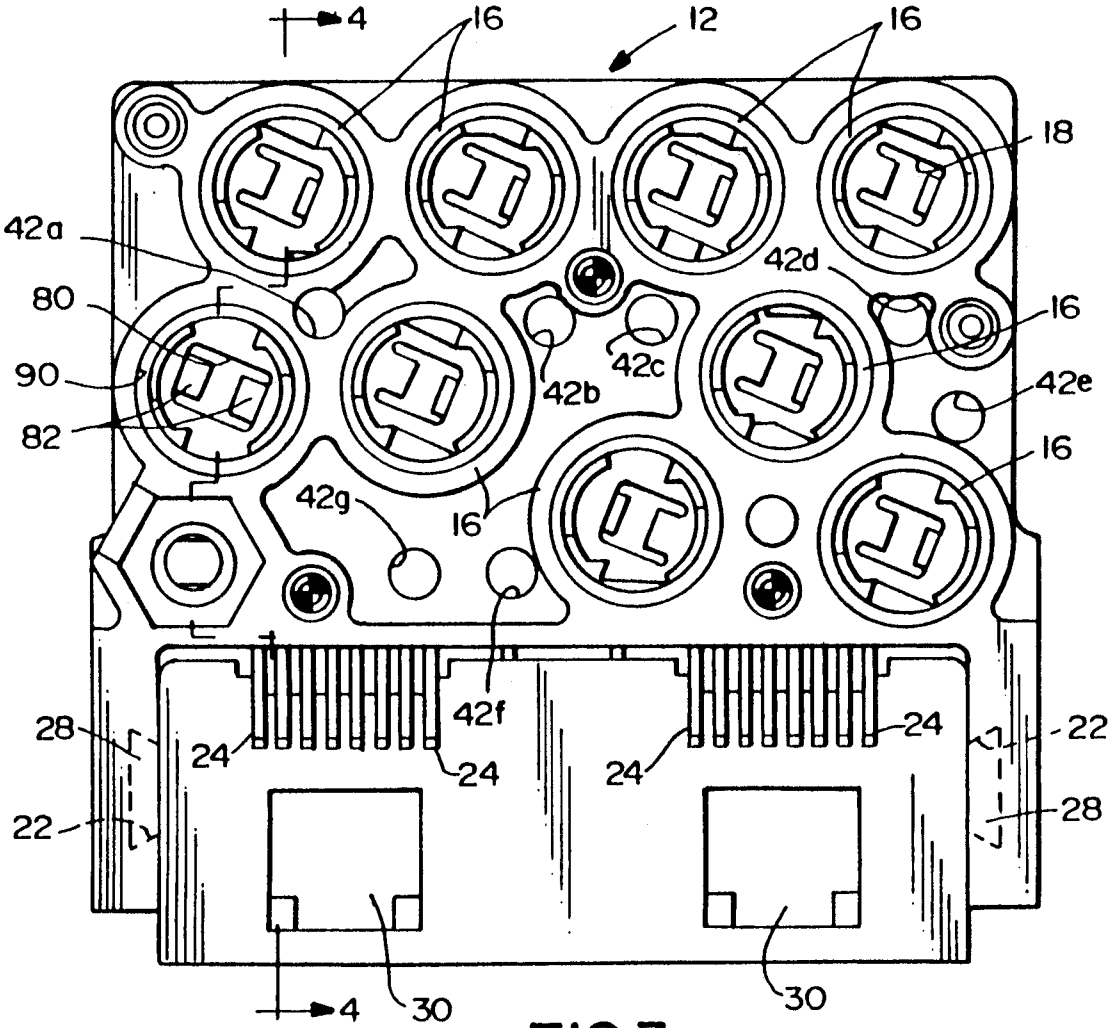
FIG. 3 is a top plan view of the base module of FIG. 1, with a dual jack housing assembled to the module.

FIG. 3 shows a dual jack housing, generally designated 26, which has dove-tail flanges 28 along opposite ends of the housing to mount the housing between arms 20 of base module 12 by an interference fit. FIG. 3 shows that the dual jack housing has a pair of receptacles 30 for receiving a conventional modular plug connector.

Figure 4:
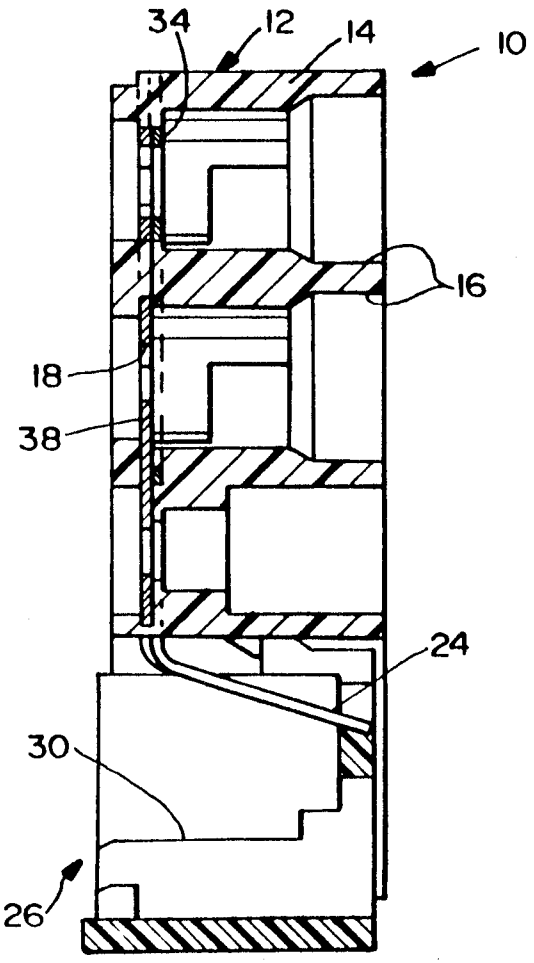
FIG. 4 is a vertical section, taken generally along line 4—4 of FIG. 3.

FIG. 4 shows how leads 24 are cantilevered inside jack housing 26 to provide spring contacts therewithin, as is conventional standard modular jacks. FIG. 4 also shows a cover, generally designated 32, for covering sockets 16 after the barrel type terminating devices have been positioned in the sockets.

It should be understood that modular jack housing 26 is a "dual connector" housing in that the singular housing effectively forms two jacks for receiving complementary plugs. The invention contemplates that two distinct jack housings could be employed with base module 12. However, the dual jack housing can be efficiently and cost-effectively unitarily molded of dielectric material.

Figure 5:
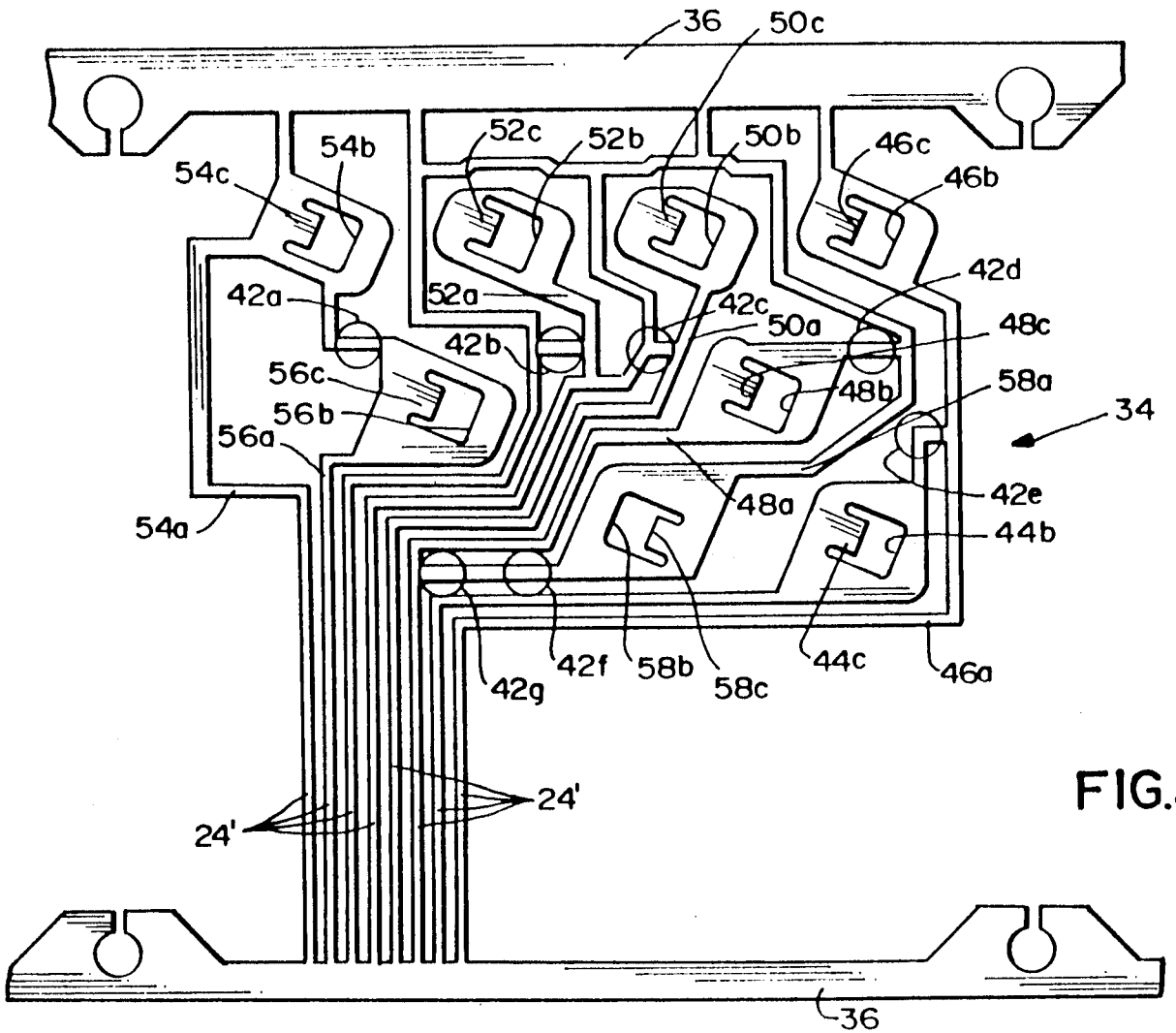
FIG. 5 is a plan view of one of the sets of circuits embedded in the base module.

The invention contemplates that at least two sets of electrical circuits be disposed within the thickness of base module 12, insulatively separated from each other, and designed to provide the terminal leads 24 for respective ones of the modular jacks as described above in relation to FIGS. 1–4. More particularly, FIG. 5 shows a first set of circuits, generally designated 34, as would be stamped and formed from sheet metal material. For illustrative purposes only, the set of circuits is shown still connected to webs 36 of a continuous strip of metal material used in mass production techniques as is known.

Figure 6:
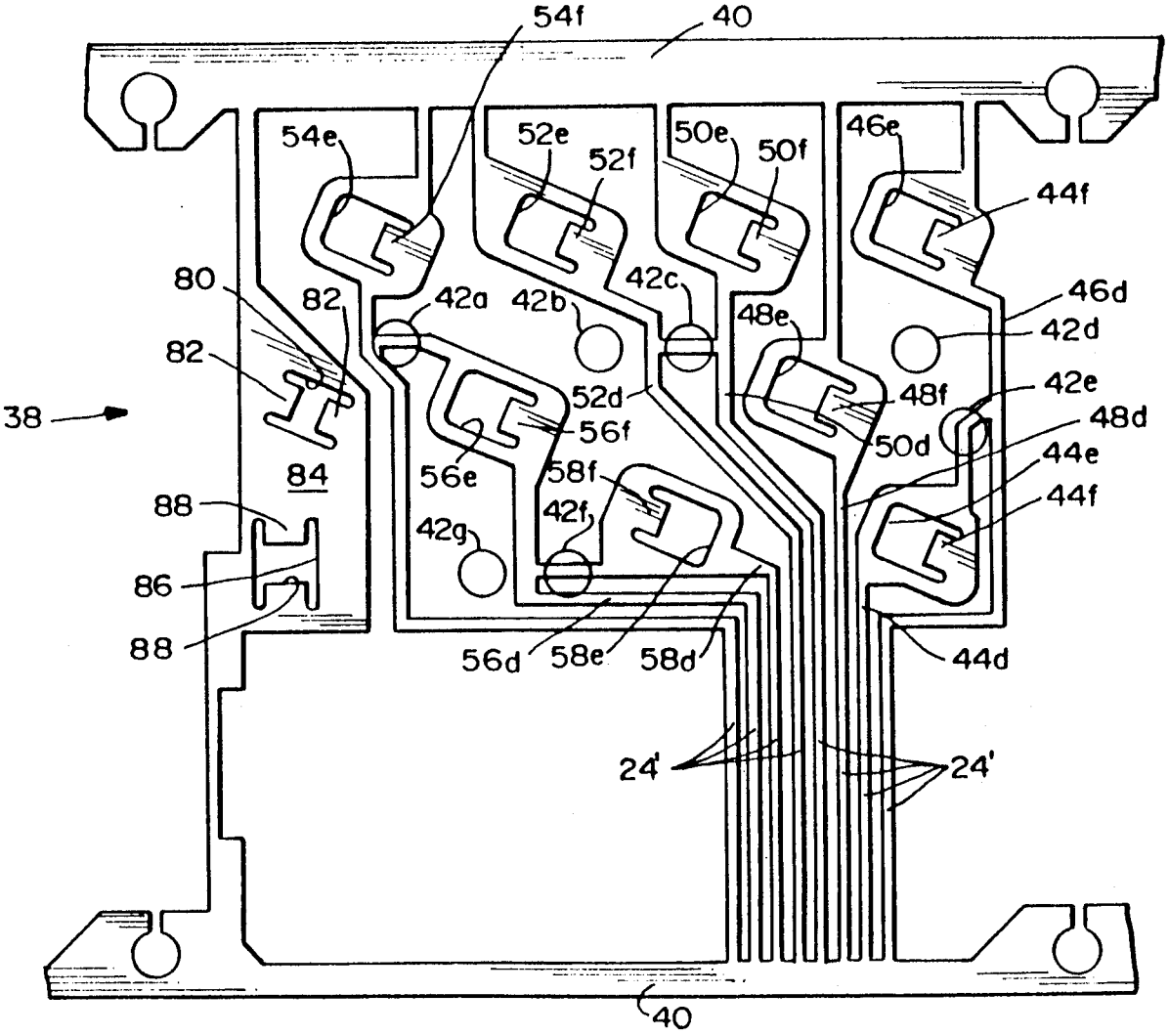
FIG. 6 is a plan view of a second set of circuits embedded in the module.

FIG. 6 shows a second set of circuits, generally designated 38, fabricated from sheet metal material similar to that of circuit set 34 in FIG. 5. Again, circuit set 38 is shown still attached to webs 40 of a continuous sheet of metal material. Before proceeding with the details of circuit sets 34 and 38, a comparison of FIGS. 5 and 6 would be helpful to show that circuit set 34 (FIG. 5) has a plurality of lead portions 24' located somewhat to the left of the overall circuit configuration. Circuit set 38 (FIG. 6) includes lead portions 24" located to the right of the overall circuit configuration. Comparing these figures with FIGS. 1 and 3, it can be understood that leads 24' (FIG. 5) of circuit set 34 will provide the cantilevered spring contacts for the left-hand jack of dual jack housing 26, and leads 24" of circuit set 38 (FIG. 6) will provide the cantilevered spring contacts for the right-hand jack of dual jack housing 26.

Each of the sets of circuits 34 and 38 have a plurality of individual circuits coupled to leads 24' and 24" respectively. As will be described in greater detail hereinafter, circuit sets 34 and 38 are superimposed within insulating base portion 14 of base module 12 and cover substantially the same area. In the preferred embodiment, circuit sets 34 and 38 are generally planar. However, it is possible that a portion of the circuit sets could be bent or curved within base module 12 so that portions on opposite sides of the bent or curved portion would be on different planes.

As stated above, FIGS. 5 and 6 show the sets of circuits still connected to webs 36, 40 as would be done in a mass production stamping operation. In order to separate the circuits from the webs and leave individual circuits coupled to leads 24' and 24", the individual circuits are severed at locations represented by circles 42*a–h* in FIGS. 5 and 6. It is contemplated that the individual circuits of both sets 34 and 38 thereof can be severed simultaneously in an appropriate fixture by a simple punching operation after the circuits are insert molded in base module 12. Therefore, for exemplary purposes, one of the circles has been identified in FIG. 5 with the reference numeral 42*a*. As seen in FIG. 5, that circle does not intersect any individual circuit of set 34. However, referring to FIG. 6, it can be seen that circle 42*a* intersects one of the circuits of set 38. The same can be seen with circle 42*b* in FIG. 6 which does not intersect any circuit in FIG. 6, but the same located circle 42*b* in FIG. 5 does intersect interconnected portions of three different circuits in order to sever the metal material and electrically isolate those circuits. Thus, it can be seen that after the circuit sets 34 and 38 are laid over each other with insulating layer 68 therebetween inside module 12, the individual circuits can be simultaneously severed without damaging or contacting portions of circuit sets 34 and 38 that should remain in tact by punching out all of the circles 42*a–h*. Such circles 42*a–h* are also shown in FIGS. 1 and 3.

The invention contemplates that each circuit set 34 and 38 has one of the individual circuits thereof to include a contact portion exposed in a respective one of the holes 18 in base module 12 in registry with sockets 16 for electrically connecting a circuit from each set 34 and 38 to a terminal pin 64 (FIGS. 8 and 9) of the barrel type terminating device. More particularly, referring to FIG. 5, a right-most aperture 44*b* of circuit 44*a* has a contact tab 44*c* projecting therefrom. Referring to FIG. 6, a right-most aperture 44*e* of circuit 44*d* has with a contact tab 44*f* projecting therefrom. When circuit sets 34 and 38 are superimposed over each other, as within base module 12, it can be seen that the distal ends of tabs 44*c* (FIG. 5) and 44*f* (FIG. 6) will be exposed within a respective one of the holes 18 in base module 12 for establishing contact with both circuit 44*a* of set 34 (FIG. 5) and circuit 44*d* of set 38 (FIG. 6) by a terminal pin of a single barrel type terminating device.

Without extensively belaboring this description of the invention, it easily can be understood by a comparison of the circuit sets in FIGS. 5 and 6 that each of the individual circuits of each set 34 and 38 have apertures and contact tabs corresponding to apertures and contact tabs of the other circuit for registry within a respective one of the holes 18 in base module 12. Consequently, even reference numerals 46–58, with appropriate alphabetical suffixes, have been applied to the remaining seven circuits in FIG. 5 and seven of the eight remaining circuits in FIG. 6, and the same description of their cooperative functions and registry relationships apply, as was described above in relation to circuit 44*a*, aperture 44*b* and its contact tab 44*c* of circuit set 34 in FIG. 5 in relation to circuit 44*d*, aperture 44*e* and its contact tab 44*f* of circuit set 38 in FIG. 6.

Aperture 80 of circuit set 38 (FIG. 6) has two tabs 82 rather than one and is connected by circuit 84 to aperture 86 which also has two tabs 88. This circuit 84 acts as a ground circuit and the apertures 80 and 86 together with their respective tabs 82 and 88 have no counterpart on circuit 34. Aperture 80 is aligned with socket 90 which is identical to sockets 16 and receives an identical type plug 60 as those received in sockets 60. A threaded terminal 92 is mechanically and electrically connected to aperture 86 and tabs 88 and receives a screw-like terminal (not shown) which is connected to a ground wire (not shown) to provide a ground circuit.

FIG. 7 shows a fragmented depiction of wiring module 10 and base module 12 with certain portions removed in conjunction with a barrel type terminal device, generally designated 60, and a plug connector, generally designated 62. It can be seen that terminating device 60 is positioned in one of the sockets 16 of base module 12, with a terminal pin 64 projecting into base 14 of the base module. Insulation layer 68 is shown positioned between circuit sets 34 and 38. FIG. 7 shows that plug connector 62 is a generally conventional plug connector for insertion into one of the receptacles 30 of dual jack housing 26. As is known, the plug connector has a plurality of contacts for engaging lead portions 24 cantilevered within the jack receptacles.

FIG. 8 shows a somewhat schematic illustration of one of the sockets 16 projecting from base portion 14 (FIG. 1) of base module 12 to illustrate one of the holes 18 in the base and how the contact tabs of individual ones of the circuits of circuit sets 34 and 38 can be exposed within the holes. More particularly, using contact tabs 44*c* (FIG. 5) and 44*f* (FIG. 6) as an example, it can be seen that the distal ends of those contact tabs are exposed or project inwardly beyond the sides of hole 18. The contact tabs are diametrically disposed from each other across the hole and are spaced diametrically from each other to electrically isolate the tabs.

Referring to FIG. 9 in conjunction with FIG. 8, the positions of tabs 44*c* and 44*f* as shown in FIG. 8 are shown in phantom in FIG. 9. However, FIG. 9 shows in solid lines that a terminal pin 64 of a terminating device 60 has been inserted into the respective socket 16 such that the terminal pin bends tabs 44*c* and 44*f* to establish a good conductive engagement between the terminal pin and the contact tabs and to securely retain the terminal pin 64 therein. FIG. 9 also shows how circuit 44*a* of circuit set 34 is spaced axially of hole 18 from circuit 44*d* of set 38 by a layer of insulating material 68.

Figure 11:
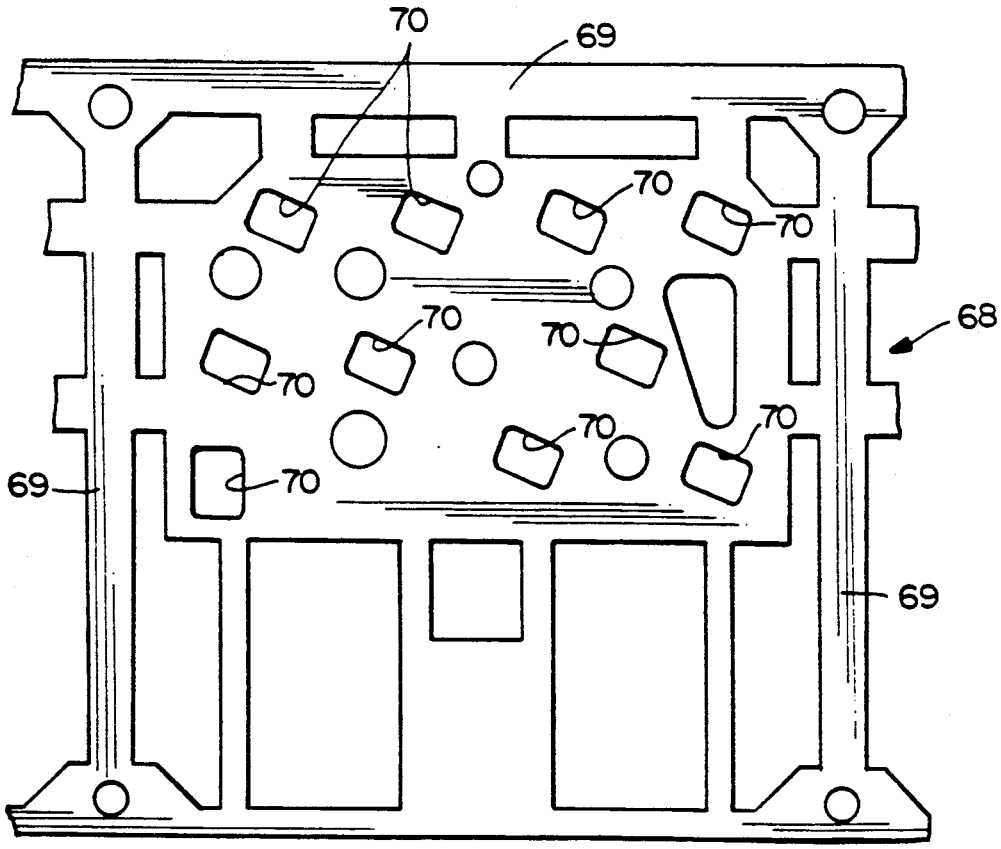
FIG. 11 is a plan view of the insulating layer located between the sets of circuits of FIGS. 5 and 6.

As shown in FIG. 11, the layer of insulating material 68 is sized and configured to insulate the entire set of circuits 34 from the entire set of circuits 38 within the molded dielectric material of base 14 of base module 12. The insulating layer is provided with holes 70 in registry with the apertures 44*b*–56*b*, 44*e*–56*e*, 80 and 86 in the circuit sets 34 and 38.

Figure 10:
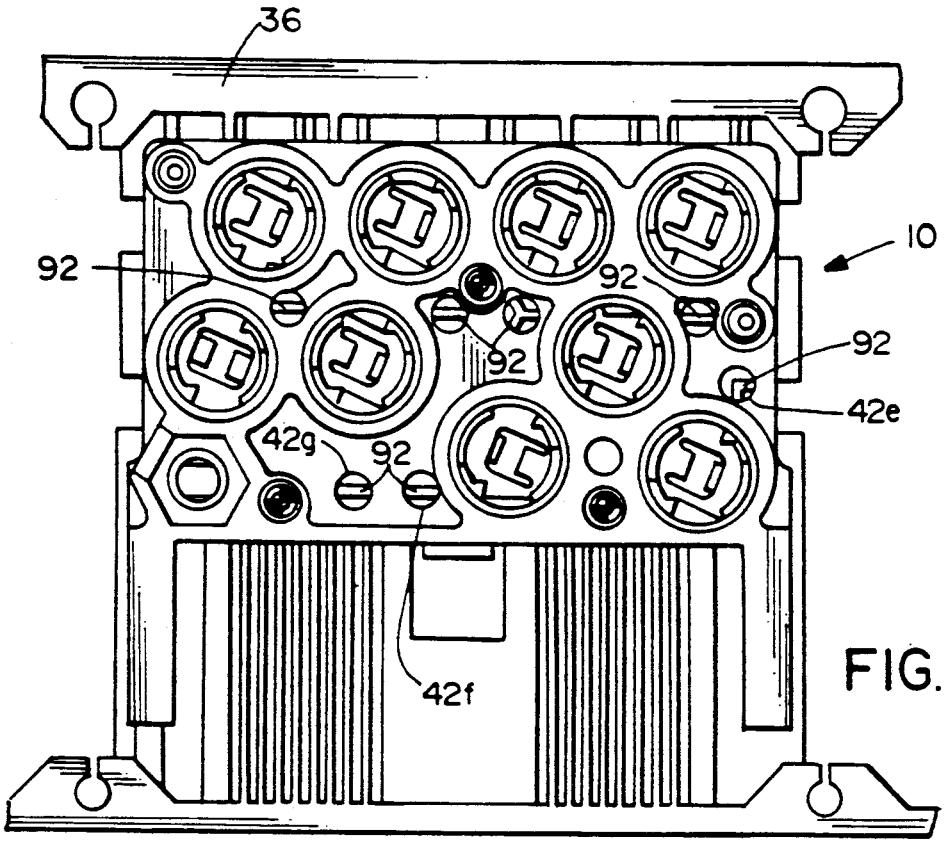
FIG. 10 is a top plan view of the base module of FIG. 1 while attached to the carrier strips.

As shown in FIG. 10, the module 10 is produced by molding base module 12 over circuit sets 34 and 38 and insulating layer 68 while circuit sets 34 and 38 are still attached to carrier strip 69. Various additional functions can be performed on module 10 while still attached to the carrier strips in order to protect lead portions 24 and to ease automated processing of the modules. While still attached to the corner strips, the portions 92 of the circuit sets 34 and 38 that will be severed through holes 42*a*–*g* are readily visible.

In summary, the design described herein produces significant increases in flexibility as to how the circuits in the module can be used. For example, the plug 62 that is inserted into the left receptacle 30 as viewed in FIG. 3 could be used for one type of transmission, such as voice, while the right receptacle 30 is used for another type, such as data. By including only those contacts that should receive voice transmissions within the plug that is inserted into left receptacle 30, and similarly only data contacts within the right plug, the circuits can be completed as desired. This structure obviously permits many variations of transmission configurations. Further, changes can be carried out without disturbing module 10. All that must be changed is which contacts 24' or 24" are contacted by the plugs 62.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

an insulative base module having a plurality of holes; and at least two sets of electrical circuits disposed within the thickness of the base module, the two sets of electrical circuits being insulatively separated from each other, each set including a plurality of circuits, each circuit having a lead portion exposed at a side of the base module for electrical connection with a complementary terminal of a mating connector device, and each set of circuits having one of the circuits thereof including a contact portion exposed in a respective one of the holes in the base module whereby a terminating device inserted into any one of the holes in the base module will engage a contact portion of one of the circuits in both sets thereof.

2. The electrical connector of claim 1 wherein said base module is molded of insulating material and said sets of electrical circuits are insert molded in the base module.

3. The electrical connector of claim 1 wherein said base module includes means on a side thereof for mounting a pair of jack type receptacles, the lead portions of the circuits of each set thereof being exposed in a respective one of the receptacles for electrical connection with contacts of a plug type connector inserted into the respective receptacle.

4. The electrical connector of claim 1 wherein each contact portion of each circuit has aperture means in registry with its respective hole in the base module.

5. The electrical connector of claim 4 wherein each contact portion has a resilient tab projecting into its respective aperture means for engagement by one of said terminating devices inserted into the respective hole in the base module.

6. The electrical connector of claim 5 wherein the tabs of the contact portions of the circuits of the two sets thereof are diametrically disposed from each other across the respective hole in the base module.

7. The electrical connector of claim 6 wherein the diametrically disposed tabs are diametrically spaced from each other.

8. The electrical connector of claim 1 wherein said sets of circuits are generally planar and spaced from each other within the insulative base module by a layer of insulating material.

9. The electrical connector of claim 8 wherein said base module is molded of insulating material and said sets of circuits are insert molded in the base module.

10. The electrical connector of claim 8 wherein each of said sets of circuits are fabricated of stamped and formed metal material.

11. The electrical connector of claim 1 wherein said insulative base module includes a plurality of sockets in registry with said holes for receiving a plurality of said terminating devices.

12. The electrical connector of claim 11 wherein said base module is unitarily molded of plastic material or the like.

13. An electrical connector, comprising:

an insulating base module having a plurality of holes; and at least two sets of generally planar electrical circuits stamped and formed of metal material disposed within the thickness of the base module and separated by a layer of insulating material, each circuit having a lead portion exposed at a side of the base module for electrical connection with a complementary terminal of a mating connector device, and each of the circuits in each set of circuits including a contact portion exposed in a respective hole in the base module, whereby a terminating device inserted into any one of the holes in the base module will engage a contact portion of one of the circuits in each set thereof.

14. The electrical connector of claim 13 wherein said base module is molded insulating material and said sets of electrical circuits are insert molded in the base module.

15. The electrical connector of claim 13 wherein said insulative base module includes a plurality of sockets in registry with said holes for receiving a plurality of said terminating devices.

16. The electrical connector of claim 13 wherein said base module includes means on a side thereof for mounting a pair of jack type receptacles, the leas portions of the circuits of each set thereof being exposed in a respective one of the receptacles for electrical connection with contacts of a plug type connector inserted into the respective receptacle.

17. The electrical connector of claim 13 wherein each contact portion has a resilient tab projecting into the respective hole in the base module.

18. The electrical connector of claim 15 wherein the tabs of the contact portions of the circuits of the two sets thereof are diametrically disposed from each other across the respective hole in the base module.

19. The electrical connector of claim 18 wherein the diametrically disposed tabs are diametrically spaced from each other.

20. In a jack type electrical connector, comprising:

an insulative base module having a plurality of holes and means for mounting at least a pair of modular jack receptacles;

at least two sets of electrical circuits disposed within the thickness of the base module and insulatingly separated from each other, each set including a plurality of circuits with lead portions exposed outside the base module at locations for positioning within a respective one of the modular jack receptacles, and each of the circuits in each set of circuits including contact means exposed in a respective one of the holes in the base module, whereby a terminating device inserted into one of the holes in the base module will interconnect with a circuit of each set thereof.

21. In a jack type electrical connector as set forth in claim 20 wherein said base module is molded of insulating material and said sets of electrical circuits are insert molded in the base module.

22. In a jack type electrical connector as set forth in claim 20 wherein said insulative base module includes a plurality of sockets in registry with said holes for receiving a plurality of said terminating devices.

23. In a jack type electrical connector as set forth in claim 20 wherein each contact means has a resilient tab projecting into its respective hole in the base module for engagement by one of said terminating devices inserted into the respective hole.

24. In a jack type electrical connector as set forth in claim 23 wherein the tabs of the contact means of the circuits of the two sets thereof are diametrically disposed from each other across the respective hole in the base module.

25. In a jack type electrical connector as set forth in claim 24 wherein the diametrically disposed tabs are diametrically spaced from each other.

26. In a jack type electrical connector as set forth in claim 20 wherein said sets of circuits are generally planar and spaced from each other within the insulative base module by a layer of insulating material.

27. In a, jack type electrical connector as set forth in claim 26 wherein said base module is molded of insulating material and said sets of circuits are insert molded in the base module.

28. In a jack type electrical connector as set forth in claim 26 wherein each of said sets of circuits are fabricated of stamped and formed metal material.

* * * * *